US006502850B1

(12) United States Patent
Schaller et al.

(10) Patent No.: US 6,502,850 B1
(45) Date of Patent: Jan. 7, 2003

(54) CORE FOR A GLIDING BOARD

(75) Inventors: Hubert S. Schaller; R. Paul Smith, both of Burlington; G. Scott Barbieri, Middlebury, all of VT (US); Paul Fidrych, Beaverton, OR (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 09/416,237

(22) Filed: Oct. 12, 1999

(51) Int. Cl.[7] ..... A63C 5/14
(52) U.S. Cl. ..... 280/610; 280/602
(58) Field of Search ..... 280/14.21, 610, 280/602, 601, 607, 608, 609, 441

(56) References Cited

U.S. PATENT DOCUMENTS

| | | | | | |
|---|---|---|---|---|---|
| 3,740,301 | A | | 6/1973 | Manning et al. | 161/58 |
| 3,758,127 | A | | 9/1973 | Doyle et al. | |
| 3,893,681 | A | * | 7/1975 | Manning et al. | 280/11.13 |
| 4,035,000 | A | * | 7/1977 | Lacroix | 280/610 |
| 4,118,050 | A | * | 10/1978 | Schnurrenberger | 280/604 |
| 4,175,767 | A | * | 11/1979 | Scheruebl | 280/610 |
| 4,383,701 | A | * | 5/1983 | Hirnbock et al. | 280/610 |
| 4,455,037 | A | | 6/1984 | Pilpel et al. | |
| 4,498,686 | A | | 2/1985 | Pilpel et al. | |
| 4,647,063 | A | | 3/1987 | Piringer et al. | 428/105 |
| 4,679,814 | A | | 7/1987 | Meatto et al. | |
| 4,690,850 | A | | 9/1987 | Fezio | 428/105 |
| 4,697,821 | A | | 10/1987 | Hayashi et al. | |
| 4,706,985 | A | * | 11/1987 | Meatto | 280/610 |
| 4,951,960 | A | | 8/1990 | Sadler | 280/607 |
| 5,005,853 | A | | 4/1991 | Lampl | |
| 5,135,249 | A | | 8/1992 | Morris | 280/609 |
| 5,169,170 | A | | 12/1992 | Hayashi | |
| 5,230,844 | A | | 7/1993 | Macaire et al. | |
| 5,238,260 | A | | 8/1993 | Scherübl | 280/610 |
| 5,366,234 | A | * | 11/1994 | Rohrmoser | 280/610 |
| 5,449,425 | A | | 9/1995 | Renard et al. | 156/78 |
| 5,544,908 | A | | 8/1996 | Fezio | 280/610 |
| 5,573,264 | A | | 11/1996 | Deville et al. | 280/602 |
| 5,580,078 | A | | 12/1996 | Vance | 280/608 |
| 5,599,036 | A | * | 2/1997 | Abondance et al. | 280/602 |
| 5,649,717 | A | | 7/1997 | Augustine et al. | 280/610 |
| 6,073,956 | A | * | 6/2000 | Zemke et al. | 280/610 |
| 6,105,991 | A | | 8/2000 | Dodge et al. | 280/610 |
| 6,183,000 | B1 | | 2/2001 | Piatti | |

FOREIGN PATENT DOCUMENTS

| | | | |
|---|---|---|---|
| DE | 21 35 278 | 1/1972 | |
| DE | 26 43 783 B1 | 3/1978 | A63C/5/12 |
| DE | 40 17 539 A1 | 1/1991 | A63C/5/12 |
| DE | 295 02 290.6 | 5/1995 | |
| EP | 0 172 851 | 3/1986 | |
| EP | 0 231 734 | 8/1987 | |
| EP | 0 284 878 | 10/1988 | |
| EP | 0306 418 | 3/1989 | |
| FR | 2 655 864 | 6/1991 | |
| FR | 2 729 086 A1 | 7/1996 | |
| JP | 5-105773 | 4/1993 | C08J/5/04 |
| JP | 8-19634 | 1/1996 | A63C/5/14 |
| JP | 9-70464 | 3/1997 | A63C/5/00 |
| JP | 10-216296 | 8/1998 | |
| WO | WO 97/22391 | 6/1997 | A63C/9/00 |
| WO | WO 97/27914 | 8/1997 | A63C/5/03 |

* cited by examiner

*Primary Examiner*—Daniel G. DePumpo
*Assistant Examiner*—Tony Winner
(74) *Attorney, Agent, or Firm*—Wolf, Greenfield & Sacks, P.C.

(57) ABSTRACT

A core for incorporation into a gliding board, such as a snowboard. The core includes longitudinal and transverse core segments with long grain configurations that are combined to adjust the edge hold and maneuverability of the board to accommodate particular riding characteristics. The core segments include anisotropic structures that are oriented relative to the orthogonal axes of the board to achieve the desired core characteristics. The transverse core segments are located along the side edges of the core and oriented to tune to the core edges for a particular edge hold and overall board maneuverability.

132 Claims, 9 Drawing Sheets

CORE FOR A GLIDING BOARD

BACKGROUND OF THE INVENTION

1. Field of the Invention

The present invention relates generally to a core for a gliding board and, more particularly, to a core for a snowboard.

2. Description of Related Art

Specially configured boards for gliding along a terrain are known, such as snowboards, snow skis, water skis, wake boards, surf boards and the like. For purposes of this patent, "gliding board" will refer generally to any of the foregoing boards as well as to other board-type devices which allow a rider to traverse a surface. For ease of understanding, however, and without limiting the scope of the invention, the inventive core for a gliding board to which this patent is addressed is disclosed below particularly in connection with a core for a snowboard.

A snowboard includes a nose, a tail, and opposed heel and toe edges. The orientation of the edges depends upon whether the rider has her left foot forward (regular) or right foot forward (goofy). A width of the board typically tapers inwardly from both the nose and tail towards the central region of the board, facilitating turn initiation and exit, and edge grip. The snowboard is constructed from several components including a core, top and bottom reinforcing layers that sandwich the core, a top cosmetic layer and a bottom gliding surface that typically is formed from a sintered or extruded plastic. The reinforcing layers may overlap the edge of the core and, or alternatively, a sidewall may be provided to protect and seal the core from the environment. Metal edges may wrap around a partial, or preferably a full, perimeter of the board, providing a hard gripping edge for board control on snow and ice. Damping material to reduce chatter and vibrations also may be incorporated into the board. The board may have a symmetric or asymmetric shape and may have either a flat base or, instead, be provided with a slight camber.

A core may be constructed of a foam material, but frequently is formed from a vertical or horizontal laminate of wood strips. Wood is an anisotropic material; that is, wood exhibits different mechanical properties in different directions. For example, the tensile strength, compressive strength and stiffness of wood have a maximum value when measured along the grain direction of the wood, while the mutually orthogonal directions perpendicular to the grain have a minimum value for these properties. In contrast, an isotropic material exhibits the same mechanical property regardless of its orientation.

Dynamic loading conditions encountered during riding induce various bending and twisting forces on the board. These force induced stresses may be applied non-uniformly across the board so that localized regions may be subject to a greater magnitude of a particular force.

For example, a rider usually lands a jump on the tail end, so that region of the board typically encounters significant bending loads resulting in high longitudinal shear stresses. When a rider executes a hard turn on edge, the board typically is subjected to significant transverse bending loads resulting in high transverse shear stresses in the region between the edge and centerline of the board. Because bindings are mounted in an intermediate region of the board, significant compression strength may be required to withstand high compression loads applied by the rider to this region when landing a jump or during a hard turn on edge. Further, forces exerted on the bindings may create high point loads that can lead to pull out of the binding insert fasteners. The region of the board between the rider's feet may encounter significant torsional loads due to opposing board twist along the board centerline when initiating or exiting a turn.

The core and reinforcing layers are the structural backbone of the board, cooperating together to withstand the above-mentioned shear, compressive, tensile and torsional stresses. Wood cores have traditionally been constructed with the grain 20 of all of the wood segments running either parallel to the base plane of the core, also known as "long grain" (FIGS. 1–2), in a nose-to-tail direction, perpendicular to the base plane, also known as "end grain" (FIGS. 3–4), or in a mixture of long grains and end grains where strips of the two types of grains are successively alternated. It also has been known to orient the long grain transversely across the core, in an edge-to-edge relationship. Consequently, in known wood cores, the segments have been oriented so that the grain extends in parallel to at least one of the orthogonal axes of the core. Additionally, in known wood cores, the long grain segments have been uniformly oriented in the same direction throughout the core. To date, the mechanical properties of the wood segments have been sufficient to respond to the various directional forces applied to the board.

Snowboard manufacturers continually strive to produce a durable, lighter board having various performance characteristics desired by riders, such as controlled flexibility, edge hold and maneuverability. It is known to reduce the weight of a board by employing lighter density materials in the core. As the density of wood decreases, however, mechanical properties may also decrease. A lower density wood segment that is oriented in standard fashion, with a long grain configuration running either nose-to-tail or edge-to-edge, or an end grain extending perpendicular to the core, may be insufficient either to withstand the loads commonly applied to a board during riding or to provide desired riding characteristics. Accordingly, there is a demand for an arrangement of a lightweight core for a gliding board that is capable of carrying various force induced stresses while providing desirable riding characteristics.

An example of a lightweight core capable of carrying various force induced stresses is disclosed in U.S. application Ser. No. 08/974,865, assigned to The Burton Corporation, the assignee of the present application, which is incorporated herein by reference. This core incorporates an off-axis anisotropic structure that is nonparallel to each of the orthogonal axes of the core requiring the use of relatively expensive manufacturing processes to fabricate the core as compared to long grain or end grain cores.

Accordingly, it would be advantageous to provide a core for a gliding board that incorporates long grain structures that are tuned to one or more specific, localized stresses or to a combination of such localized stresses.

SUMMARY OF THE INVENTION

The present invention is a flexible, durable, rider responsive core for a gliding board, such as a snowboard. The core imparts strength and stiffness so that a board incorporating the core may carry loads induced either in a direction parallel to an axis of the board as well as off-axis, or combinations thereof. The core cooperates with other components of the gliding board, such as with reinforcing layers positioned above and below the core, to provide a board with balanced torsion control and overall flexibility that quickly responds to rider induced loads, such as turn initiation and exit, that promptly recovers on landings after jumping or riding over bumpy terrain (moguls), and that maintains firm edge contact with the terrain. A gliding board incorporating the core is maneuverable and provides enhanced edge hold to the rider. A specific flex profile may be milled into the core, allowing a gliding board to be fine tuned to a specific range of riding performance.

The core includes a nose end, a tail end and opposed edges. Nose end refers to that portion of the core that is closest to the nose when the core is incorporated into the gliding board. Tail end, similarly, refers to that portion of the core that is closest to the tail when the core is assembled within the gliding board. The nose and tail ends may be constructed to extend the full length of the gliding board and be shaped to match the contour of the nose and tail of the gliding board. Alternatively, the core may extend only partially along the length of the gliding board and not include compatible end shapes. Symmetrical and asymmetrical core shapes are contemplated.

The core is formed from a thin, elongated member with a thickness that may vary, for example from a thicker central region to more slender ends, imparting a desired flex response to the board. However, a core of uniform thickness also is contemplated. Prior to incorporation into the gliding board, the core may be substantially flat, convex, or concave, and the shape of the core may be altered during fabrication of the gliding board. Consequently, a flat core may ultimately include a camber, and have upturned tail and nose ends, after the gliding board is completely assembled.

The gliding board preferably includes one or more anisotropic structures, such as wood, each having a principal axis (the direction of the grain when the anisotropic structure is wood) along which a mechanical property that influences the riding performance of the gliding board has a maximum value. The principal axis may be defined by either an angle relative to the longitudinal axis, transverse axis and normal axis of the core or an angle relative to a plane formed by any two of the axes. Although the anisotropic structure may be arranged to provide a maximum value for a particular contemplated load, preferably the principal axis is oriented to provide a balanced value for two or more anticipated load conditions. In the latter case, the principal axis may be oriented so that it does not provide a maximum value for any of the contemplated loads but, rather, a desired blended value.

The anisotropic structure is oriented so that the principal axis lies in a plane that is parallel to the base plane of the core in a long grain configuration. The incorporation of long grain structures permits the core to be manufactured using relatively economical processes. In a core that employs a single anisotropic structure orientation, the principal axis is oriented so that it is not in alignment with, or is not parallel to, either of the longitudinal axis or the transverse axis. In a core that employs at least two anisotropic structures in a long grain configuration, the principal axes of the two structures are oriented in different directions relative to each other.

Where the anisotropic structure is wood, the grain of the wood is parallel to the base plane of the core in a long grain fashion. Although a wood anisotropic structure is preferred, other anisotropic structures are contemplated including a fiberglass/resin matrix, a molded thermoplastic structure, honeycomb, and the like. Furthermore, one or more isotropic materials may be formed into an anisotropic structure that is suitable for use in the present core, for example glass, which itself is isotropic, may be formed into fibers that may be aligned with each other in a resin matrix to form an anisotropic structure.

In one embodiment of the invention, the core includes a thin, elongated member having a nose end, a tail end and a pair of opposed edges. The core includes a longitudinal axis extending in a nose-to-tail direction, a transverse axis extending in an edge-to-edge direction and a normal axis that is perpendicular to a base plane extending through the longitudinal axis and the transverse axis. The thin, elongated member includes an anisotropic structure that has a principal axis along which a mechanical property has a maximum value, where the mechanical property is selected from one or more of compressive strength, compressive stiffness, compressive fatigue strength, compressive creep strength, tensile strength, tensile stiffness, tensile fatigue strength and tensile creep strength. The anisotropic structure is arranged in the core member so that it extends from at least one of the opposed edges of the core with the principal axis lying in a plane extending parallel to the base plane of the core and being not aligned with, or not in parallel to, each of the longitudinal and transverse axes of the core member.

In another embodiment of the invention, the thin, elongated member includes first and second anisotropic structures respectively having first and second principal axes. The anisotropic structure is arranged in the core member so that each of the first and second principal axes lie in a plane extending parallel to the base plane of the core with the first principal axis being oriented in a first direction and the second principal axis being oriented in a second direction that is different from the first direction.

A still further embodiment of the invention includes a gliding board incorporating a thin, elongated core as described in any of the embodiments herein. The gliding board may further include a reinforcing layer, such as one or more sheets of a fiber reinforced matrix, above and below the core. A bottom gliding surface and a top riding surface also may be provided, as may perimeter edges for securely engaging the terrain. Damping and vibrational resistant materials also may be included, as appropriate.

It is an object of the present invention to provide an improved core for a gliding board.

It is another object of the present invention to provide a core for a gliding board with the structural integrity to handle the anticipated mechanical loads placed on the gliding board.

It is a further object of the invention to provide a core for a gliding board having selected regions along the edges of the core that are configured to provide a desired amount of edge hold along the edges of the board.

Other objects and features of the present invention will become apparent from the following detailed description when taken in connection with the accompanying drawings. It is to be understood that the drawings are designed for the purpose of illustration only and are not intended as a definition of the limits of the invention.

BRIEF DESCRIPTION OF THE DRAWINGS

The foregoing and other objects and advantages of the invention will be appreciated more fully from the following drawings in which.

DETAILED DESCRIPTION OF THE INVENTION

Figure 1:
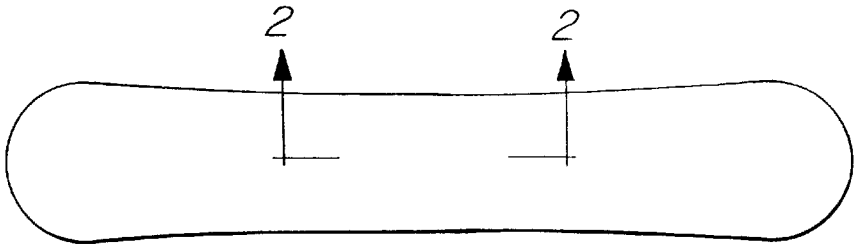
FIG. 1 PRIOR ART
FIG. 1 is a schematic view of a wood core with long grain segments.
Figure 3:
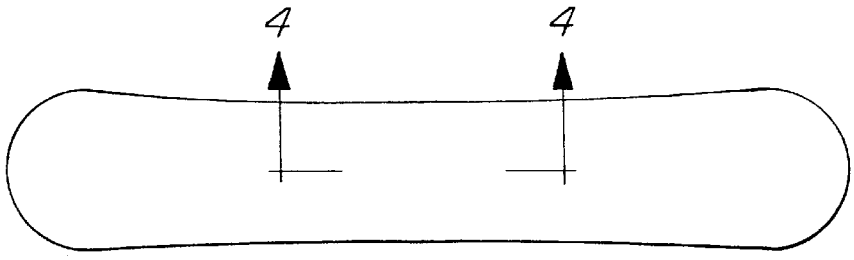
FIG. 3 PRIOR ART
FIG. 3 is a schematic view of a wood core with end grain segments.
Figure 2:
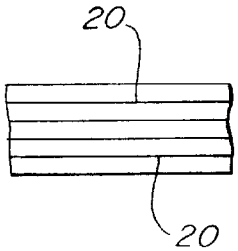
FIG. 2 PRIOR ART
FIG. 2 is a cross-sectional view taken along section line 2—2 in FIG. 1.
Figure 4:
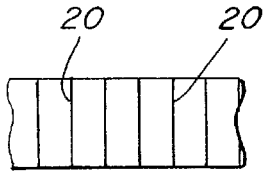
FIG. 4 PRIOR ART
FIG. 4 is a cross-sectional view taken along section line 4—4 in FIG. 3.
Figure 5:
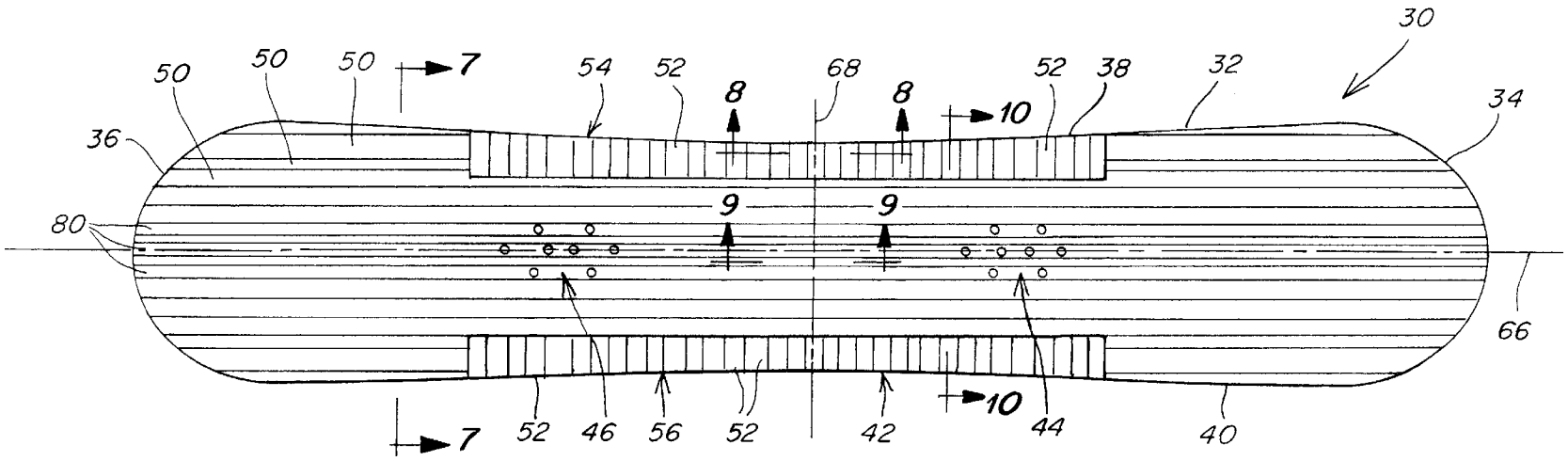
FIG. 5 is a is a top plan view of the core according to one illustrative embodiment of the invention.
Figure 6:
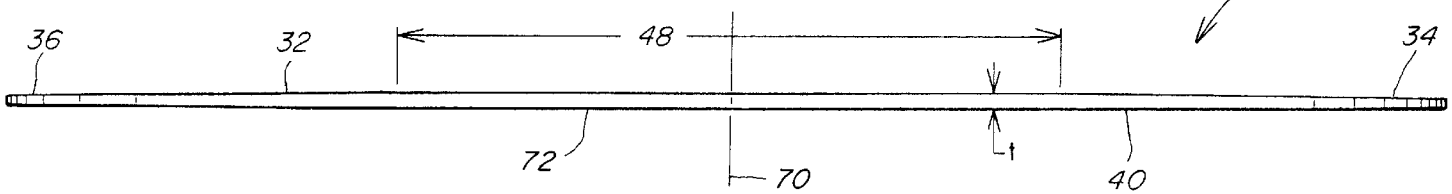
FIG. 6 is a side elevational view of the core of FIG. 5.
Figure 8:
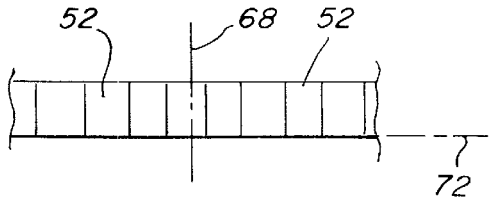
FIG. 8 is a cross-sectional view of the core taken along section line 8—8 in FIG. 5
Figure 7:
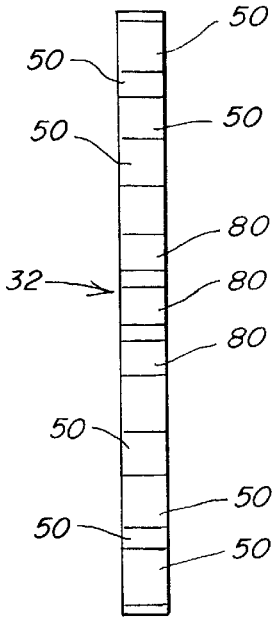
FIG. 7 is a cross-sectional view of the core taken along section line 7—7 in FIG. 5.
Figure 9:
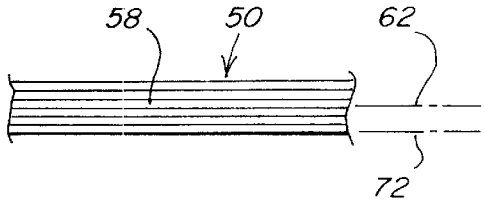
FIG. 9 is a cross-sectional view of the core taken along section line 9—9 in FIG. 5
Figure 10:
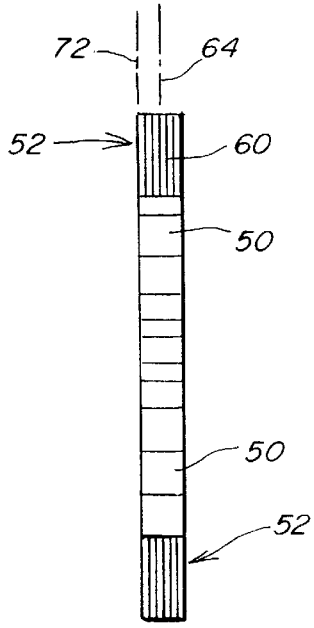
FIG. 10 is a cross-sectional view of the core taken along section line 10—10 in FIG. 5

In one embodiment of the invention, shown in FIGS. 5–10, a core is provided for incorporation into a gliding board, such as a snowboard. The core 30 includes a thin, elongated core member 32 that has a rounded nose end 34, a rounded tail end 36 and a pair of opposed side edges 38, 40 that extend between the nose end and the tail end. It is to be appreciated, however, that the core shape can be varied to conform to the desired final configuration of the board. In that respect, the core 30 may have a symmetrical or an asymmetrical shape, depending upon the desired rider flex profile of the board. Although a full length core, running nose-to-tail, is illustrated, a partial length core also is contemplated that may lack one or both of the rounded nose and tail ends. The core 30 may be provided with a sidecut 42, as shown, or may instead be constructed of a uniform width. As shown in FIG. 5, the core 30 may be provided with first and second groups 44, 46 of openings or holes that correspond to the regions where front and rear bindings, such as snowboard bindings, will be secured to the board. The openings in the core are adapted to receive fastener inserts (not shown) for securing the bindings. The pattern of the openings may be varied to accommodate different insert fastening patterns.

The core 30 may have a uniform thickness t or, preferably, may have a thickness t that varies from a thicker central region 48 that includes the openings 44, 46 for receiving the fastener inserts to the narrower, and more flexible, nose and tail ends 34, 36. It is to be appreciated that other thickness variations are also contemplated as would be apparent to one of skill in the art. In one embodiment, the thickness varies from approximately 8 mm at the central region 48 to approximately 1.8 mm at the ends 34, 36. Although the core, prior to incorporation into the gliding board, preferably is substantially flat, it also may be configured with a convex or concave shape. Further, the shape of the core may be altered during fabrication of the gliding board. Consequently, a flat core may ultimately include a camber, and the nose and tail ends may curve upwardly, after final assembly of the board.

A plurality of longitudinal core segments 50 and a plurality of transverse core segments 52 are secured together, such as by vertical lamination, to form the unitary core member 32. As shown, the longitudinal core segments 50 extend nose-to-tail and are distributed transversely across the width of the core. A single core segment 50 may extend along the full length of the core or, alternatively, several shorter segments may be joined end-to-end. The transverse core segments 52 extend in a direction transverse to the longitudinal core segments 50. As shown, the transverse core segments 52 extend in the edge-to-edge direction and are distributed in elongated regions 54, 56 along the opposed edges 38, 40 of the core with longitudinal core segments 50 disposed therebetween. The width of the core segments 50, 52 may be uniform throughout the core member 32 or may vary as desired. In one embodiment, the width of the core segments 50, 52 may range from approximately 4 mm to approximately 20 mm, with a preferred width of approximately 10 mm.

Each core segment 50, 52 includes at least one anisotropic structure 58, 60 (FIGS. 9–10) having a principal axis 62, 64, along which a mechanical property of the anisotropic structure has a maximum value. Such a mechanical property includes one or more of compressive strength, compressive stiffness, compressive fatigue strength, compressive creep strength, tensile strength, tensile stiffness, tensile fatigue strength and tensile creep strength.

The anisotropic structure 58, 60 of each core segment 50, 52 is oriented so that the respective principal axis 62, 64 extends in a predetermined direction and at a predetermined angle appropriate for one or more of the anticipated loading conditions to be encountered when riding the board. The angle and direction of the principal axis 62, 64 may be defined in relation to an orthogonal coordinate system for the core that includes a longitudinal axis 66, a transverse axis 68 and a normal axis 70. The longitudinal axis 66 extends in a nose-to-tail direction along the centerline of the core, the transverse axis 68 extends in an edge-to-edge direction at the longitudinal center between the nose and tail ends 34, 36 of the core (perpendicular to the longitudinal axis), while the normal axis 70 is perpendicular to the base plane 72 of the core extending through the longitudinal and transverse axes. The coordinate system also defines a longitudinal plane extending through the longitudinal and normal axes, and a transverse plane extending through the transverse and normal axes.

The anisotropic structures 58, 60 for each of the longitudinal and transverse core segments 50, 52 are arranged in the core so that their respective principal axes 62, 64 lie in a plane that is parallel to the base plane 72 of the core. When the anisotropic structures are formed of wood, such an orientation means the wood grain has a long grain configuration. The principal axis 62 of the longitudinal core segments 50, however, extends in a direction that is different from the direction of the principal axis 64 of the transverse core segments 52. The particular orientation of the principal axes for the longitudinal and transverse core segments may be selected to configure the core with predetermined riding and durability characteristics and to handle the contemplated loading conditions on the core. Although the longitudinal and transverse core segments may employ any orientation suitable to provide the desirable characteristics, a combination of various long grain orientations allows the core to be manufactured in various configurations using relatively economical processes.

Figure 11:
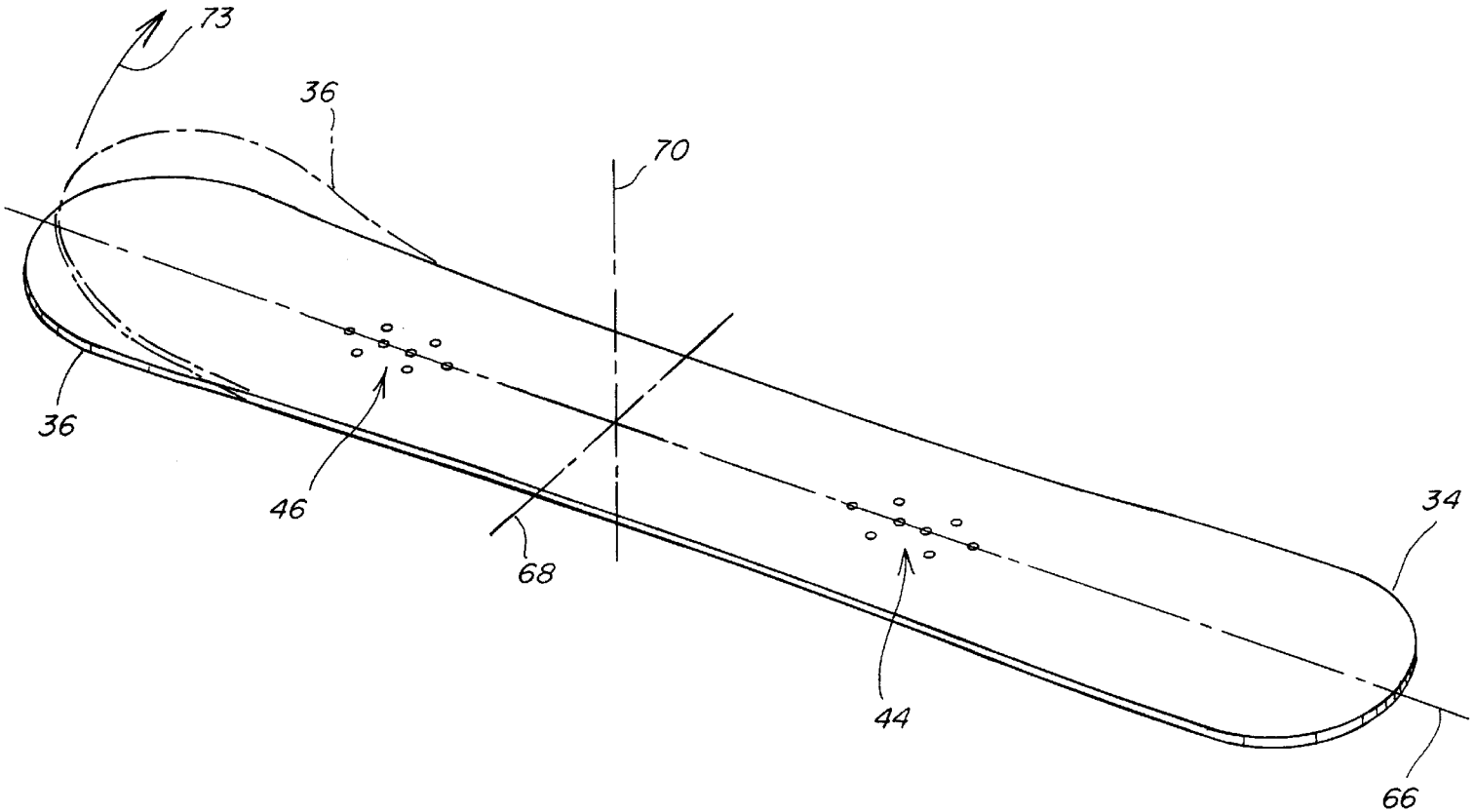
FIG. 11 is a schematic view of a core illustrating a shear load due to longitudinal bending of the core.

In one embodiment, the principal axis 62 for each of the longitudinal core segments 50 is oriented parallel to the longitudinal axis 66 of the board. This particular long grain orientation provides a core that has overall good durability with smooth flex characteristics from nose-to-tail. This orientation is suitable for handling a longitudinal shear load that is applied to the core along the longitudinal axis 66 approximately midway between the rear binding region 46 and the tail end 36 of the board. This loading condition, which is typically the major loading on a board, may occur when landing a jump that causes the tail end 36 of the board to bend upwardly 73, as shown in phantom in FIG. 11, along an axis that is parallel to the transverse axis 68. This configuration similarly handles a loading condition in the opposite direction, such as bending the tail end of the board down.

Figure 12:
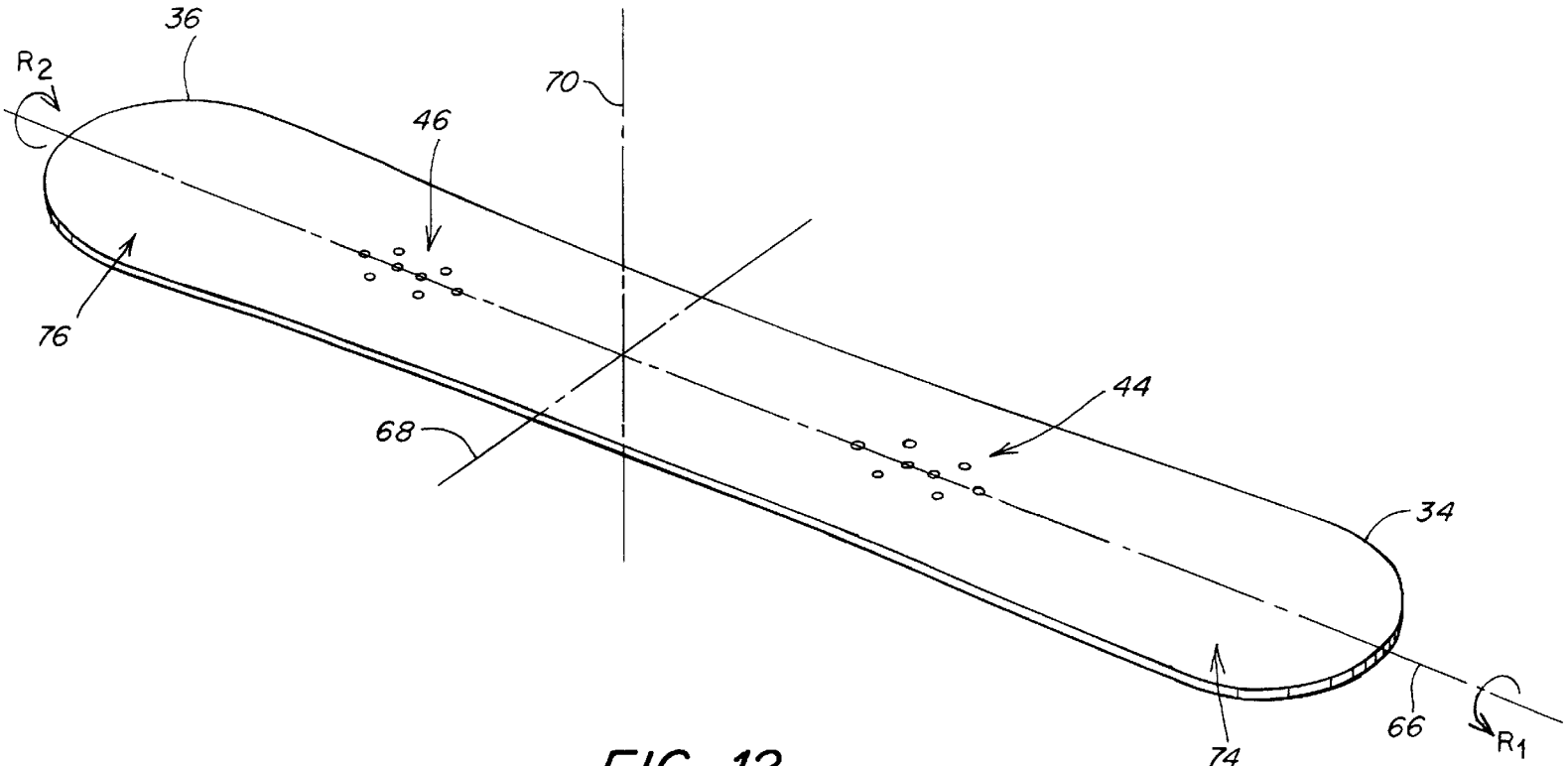
FIG. 12 is a schematic view of a core illustrating a shear load due to transverse bending of the core.

This orientation also allows the core to flex about the longitudinal axis 66 in response to a torsional load that is applied to the center portion of the core between the front and rear binding regions 44, 46 off the longitudinal axis 66 as shown in FIG. 12. This loading condition may occur when initiating and exiting a turn that causes the board to twist along the longitudinal axis 66. In particular, the nose portion 74 of the board twists in one direction $R_1$ about the longitudinal axis 66 and the tail portion 76 of the board twists in the opposite direction $R_2$ about the longitudinal axis.

Figure 13:
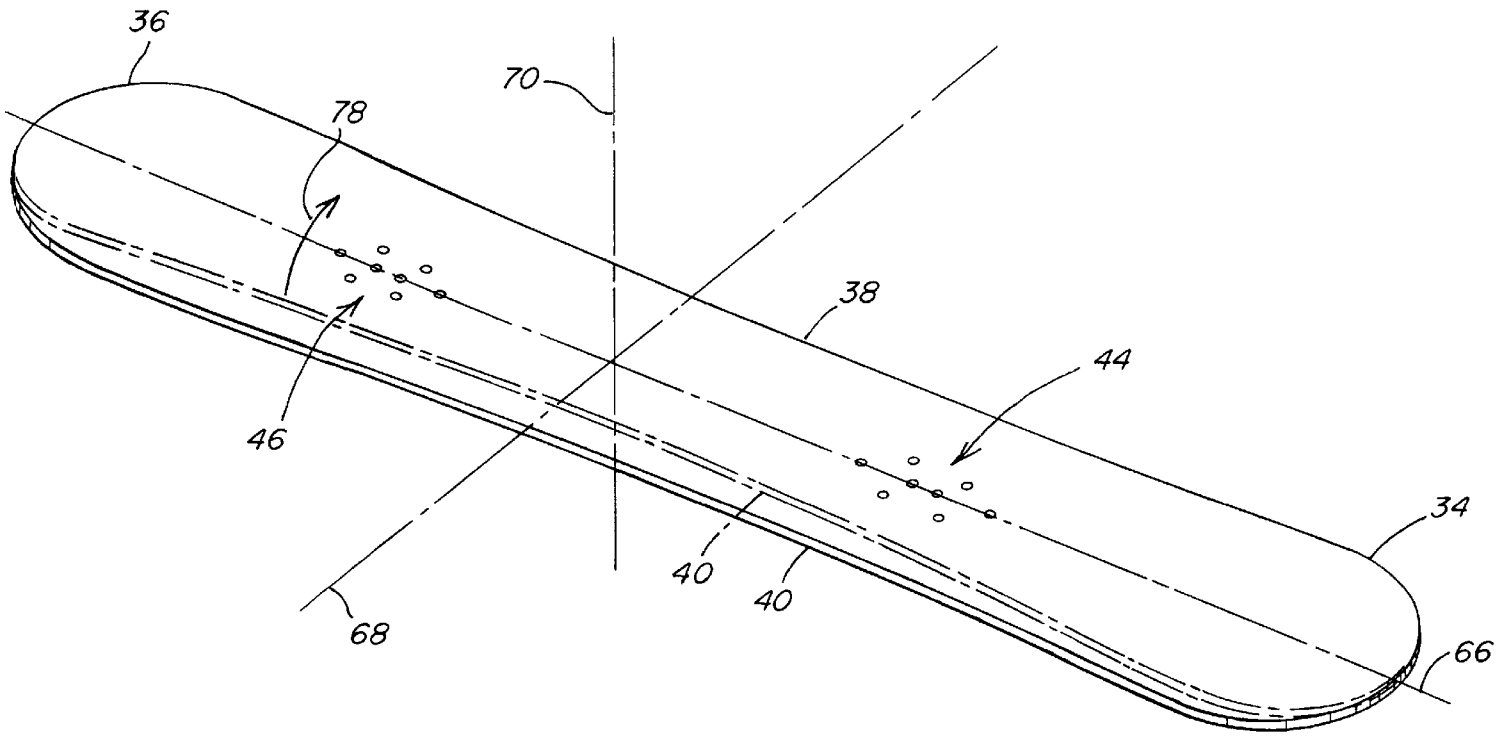
FIG. 13 is a schematic view of a core illustrating a torsional load due to twisting of the core.

Incorporating the above-described long grain orientation along the core edges 38, 40, however, may not always be suitable for providing a rider with a desired amount of edge hold or edge grip for executing a hard turn on edge. In particular, such a maneuver produces a transverse shear load that is applied between the longitudinal axis 66 and the carving edge 40 of the board and causes the edge to bend upwardly 78 along an axis that is parallel to the longitudinal axis 66 as shown in FIG. 13. An increase in the stiffness of the core edges 38, 40 reduces the amount of edge flex and results in a board having increased edge hold. When employing core segments having long grain configurations, the stiffness of the core edges 38, 40 relative to transverse shear loading may be increased by orienting the principal axes of the core segments away from the longitudinal axis 66 and toward the transverse axis 68.

In one embodiment illustrated in FIG. 5, the principal axis 64 for each of the transverse core segments 52 provided in the edge regions 54, 56 of the core is oriented parallel to the transverse axis 68 of the board. This particular long grain orientation provides a core with maximum relative stiffness along its edges resulting in a board with a high degree of edge hold as compared to a core employing long grain orientation that is parallel to the longitudinal axis across the entire width of the core. As suggested above, however, the principal axes of the transverse core segments may oriented in any direction to provide a preselected degree of edge hold.

Figure 14:
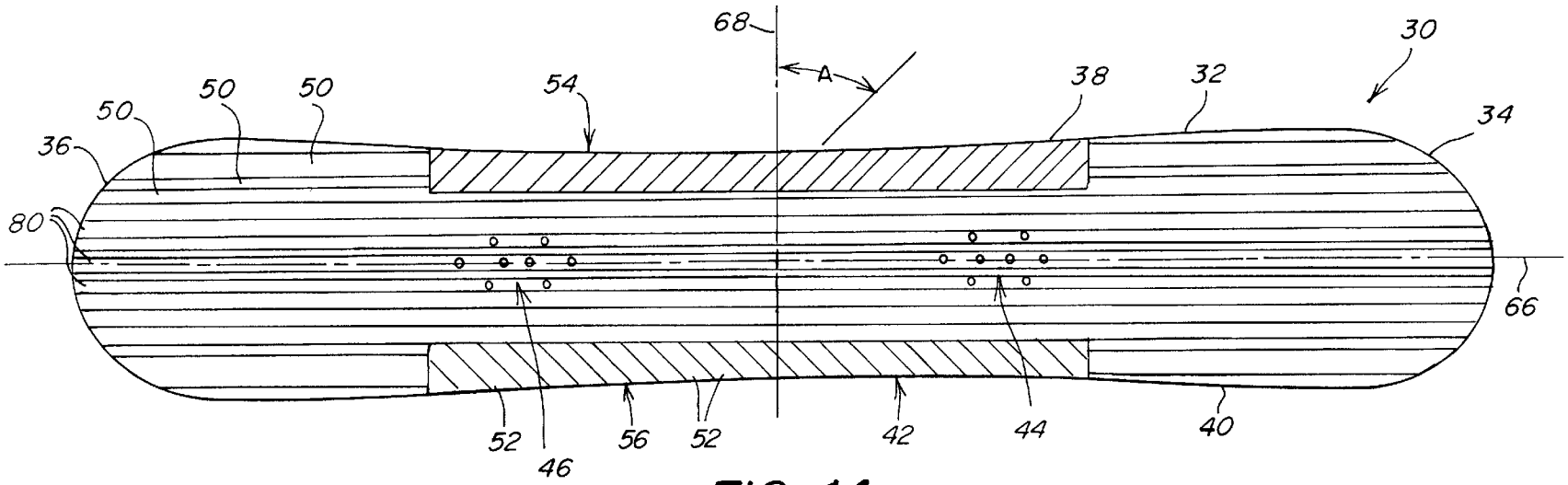
FIG. 14 is a top plan view of the core according to another illustrative embodiment of the invention incorporating angled core segments along the edges of the core.

In another embodiment illustrated in FIG. 14, the principal axes 64 of the transverse core segments 52 in each of the edge regions 54, 56 of the core are oriented at an angle A from either the transverse axis 68 (as shown) or the longitudinal axis 66 so that the principal axes are non-parallel to both the transverse and longitudinal axes. As the principal axis 64 of the transverse core segments 52 is oriented away from the transverse axis 68 toward the longitudinal axis 66, the stiffness of the core edges 38, 40 and consequently the edge hold of the core, decreases. Conversely, as the principal axis 64 of the transverse core segments 52 is oriented more toward being parallel to the transverse axis 68, the stiffness and edge hold increases. Accordingly, the core may be configured with a desired amount of edge hold by adjusting the orientation of the transverse core segments 52 relative to the transverse and longitudinal axes.

The principal axis 64 of the transverse core segments 52 may have an angle A of between 10° and 80° relative to one of the transverse and longitudinal axes. Preferably, the angle A is between approximately 30° and approximately 60° to provide a core having a combination of good edge hold and board maneuverability. In one embodiment, the principal axis of the transverse core segments is approximately 45°.

Since the major transverse shear loading along the core edges occurs in the vicinity of the binding regions 44, 46, it is desirable to provide the transverse core segments 52 along the core edges adjacent at least a portion of the front and rear binding regions. As shown in FIGS. 5 and 14, the elongated regions 54, 56 of transverse core segments 52 may extend continuously along the core edges 38, 40 from the front binding region 44 toward the rear binding region 46. Although the transverse core segments 52 may extend along the entire length of the core edges, it is preferable to extend the regions slightly forward of the front binding region 44 and rearward of the rear binding region 46, as illustrated, so that the nose and tail portions of the core remain relatively flexible for board maneuverability while still providing the desired edge stiffness at the binding regions.

In one embodiment for board lengths of approximately 140 to 185 cm, each region of transverse core segments 52 has a length along the core edges of approximately 80 cm and extends approximately 10 cm forward and rearward of the front and rear binding regions 44, 46, respectively. Each region of transverse core segments has a width in the edge-to-edge direction of approximately 2 to 5 cm. In another embodiment for board lengths of approximately 128 to 142 cm, each region of transverse core segments 52 has a length along the core edges of approximately 60 cm. It is to be appreciated, however, that the length and width of the transverse core segment regions may be varied to provide any desired combination of edge hold and core flexibility.

Figure 15:
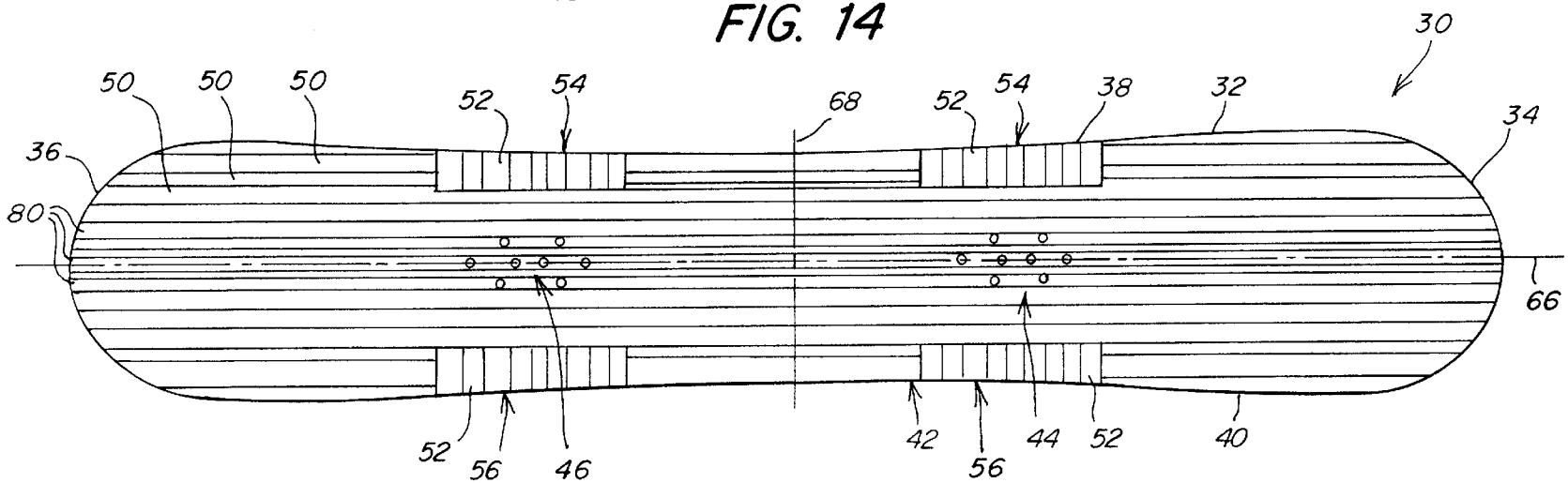
FIG. 15 is a schematic view of a core having multiple regions of anisotropic structures along each edge of the core.

Since the major transverse shear loading affecting edge hold occurs in the vicinity of the binding regions, as indicated above, it may be desirable to locate discrete regions of transverse core segments along the core edges proximate the binding regions. In one embodiment shown in FIG. 15, a pair of spaced transverse core segment regions 54, 56 is provided along each of the core edges 38, 40 proximate the binding regions 44, 46 of the core. The principal axes in each region may be oriented at the same angle relative to the transverse axis or, alternatively, the principal axes in one transverse region may be oriented at an angle that differs from the principal axes in another transverse region.

As illustrated, the longitudinal core segments 50 in the central region of the core extend entirely across the width of the core from edge to edge between the spaced regions of transverse core segments. This configuration increases the torsional flexibility between the bindings while limiting the transverse bending to specific locations along the edges of the core. It is to be appreciated that the core may incorporate any suitable transverse region configuration.

Forces exerted on the bindings may create high point loads that can cause pull out of the fastener inserts.

Consequently, the core 30 may be provided with one or more third core segments 80 that includes a third anisotropic structure that is capable of distributing the point loads over a larger region of the core. The third anisotropic structure may be formed of a different material than the anisotropic structures 58, 60 of the longitudinal and transverse core segments or, if formed of the same material, have a principal axis with an orientation that is different from the longitudinal and transverse anisotropic structures 58, 60. Preferably, the principal axis of the third anisotropic structure extends along the length of the third segment 80 in a plane parallel to the base plane 72 of the core to create a beam segment that effectively carries the point loads away from the fastener inserts.

As illustrated in FIG. 5, the third core segments 80 may correspond to the locations of the openings 44, 46 so that the fastener inserts will be mounted on these beam segments. To further enhance the insert retention capacity of the core, the beam segments 80 may include a higher strength material relative to the longitudinal and transverse core segments 50, 52. For, example, the beam segments 80 may include a higher density wood than used in the first and second core segments. Further, the third core segments 80 may be arranged in an alternating relationship with the longitudinal core segments 50. Although the third core segments 80 are illustrated as extending from nose-to-tail, they may be provided only in the regions of the binding insert openings 44, 46 or in varying lengths therefrom toward the nose and tail ends 34, 36. The third core segments 80 may also be oriented in the edge-to-edge direction or any radial direction away from the insert.

As discussed above, the anisotropic structures for each core segment 50, 52 may be oriented in predetermined directions that are suitable for handling the anticipated loading conditions to be encountered when riding the board. The core segments 50, 52 may also be oriented to produce a core having particular riding characteristics. As may be appreciated from the discussion of the previous embodiments, various anisotropic structure orientations may be employed in different regions of the core to selectively tune localized areas of the core to particular loading conditions or riding characteristics. To further illustrate this concept, the following examples are presented to describe several core configurations that may employ core segments with varying long grain orientations within the core. It is to be understood, however, that the examples are included for illustrative purposes only and are not intended to limit the scope of the invention.

Figure 16:
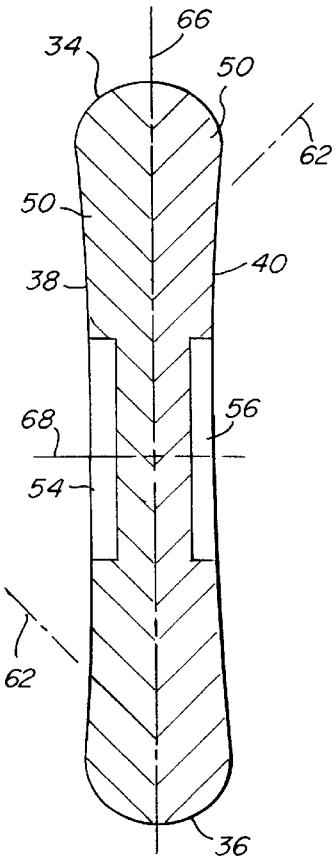
FIGS. 16–18 are schematic views of further illustrative embodiments of a core according to the present invention.

FIG. 16 illustrates a core configuration in which the longitudinal core segments 50 have been oriented so that their principal axes 62 are non-parallel to both the longitudinal axis 66 and the transverse axis 68. As illustrated, the core segments 50 may be disposed symmetrically about the longitudinal axis 66 with their principal axes 62 being angled from the longitudinal axis toward the nose end of the core. This particular configuration enhances the durability of the tail section of the core by aligning the principal axes with anticipated forces that may be applied between the rear binding and the board when landing a jump on the tail end of the board. The angular orientation of the longitudinal core segments by itself provides an enhanced degree of edge hold that may be sufficient to some riders. It is to be appreciated, however, that the core may also include transverse core segments 52 along the side edges 38, 40, as described above, to provide a particular degree of edge hold.

Figure 17:
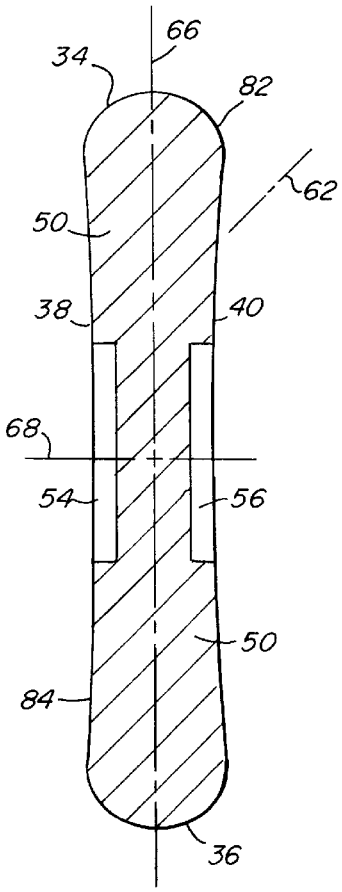

FIG. 17 illustrates another core configuration in which the longitudinal core segments 50 are oriented so that their principal axes 62 are non-parallel to both the longitudinal axis 66 and the transverse axis 68. In contrast to FIG. 16, as described above, the core segments 50 extend across the entire width of the core with their principal axes 62 being angled in a direction toward the nose end 34 of the core from one edge 38 toward the opposite edge 40 of the core. The orientation of the principal axes 62 may be selected so that they are aligned with the bindings mounted to the board in a rider's desired stance.

This configuration provides asymmetrical riding characteristics that some riders may find desirable. In particular, for a regular riding stance in which the left foot is placed forward toward the nose end 34 of the board, forces are directed along the principal axes 62 toward the right front edge 82 of the board during a front side turn. Similarly, forces are directed along the principal axes 62 toward the left rear edge 84 during a rear side turn. The angular orientation of the longitudinal core segments 50 by itself provides an enhanced degree of edge hold that may be sufficient to some riders. It is to be appreciated, however, that the core may also include transverse core segments 52 along the side edges 38, 40, as described above, to provide a particular degree of edge hold.

Figure 18:
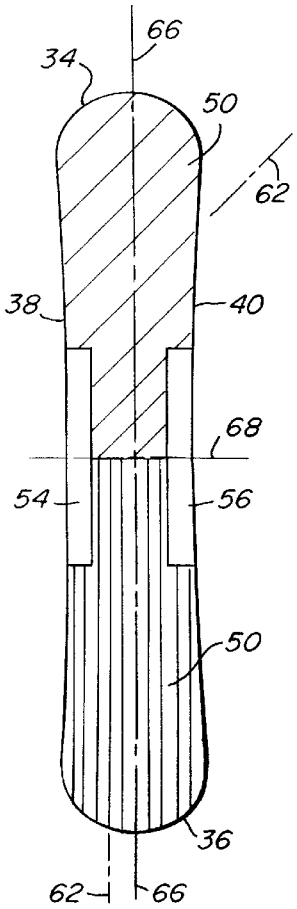

FIG. 18 illustrates a core configuration that combines a tail section similar to that described above in connection with FIGS. 5–10 and a nose section similar to that described above in connection with FIG. 16. This configuration combines smooth flex and durability in the tail end 36 of the board with force direction toward the nose 34 of the board during a front side turn. The core may also include transverse core segments 52 along the side edges 38, 40, as described above, to provide a particular degree of edge hold.

Figure 19:
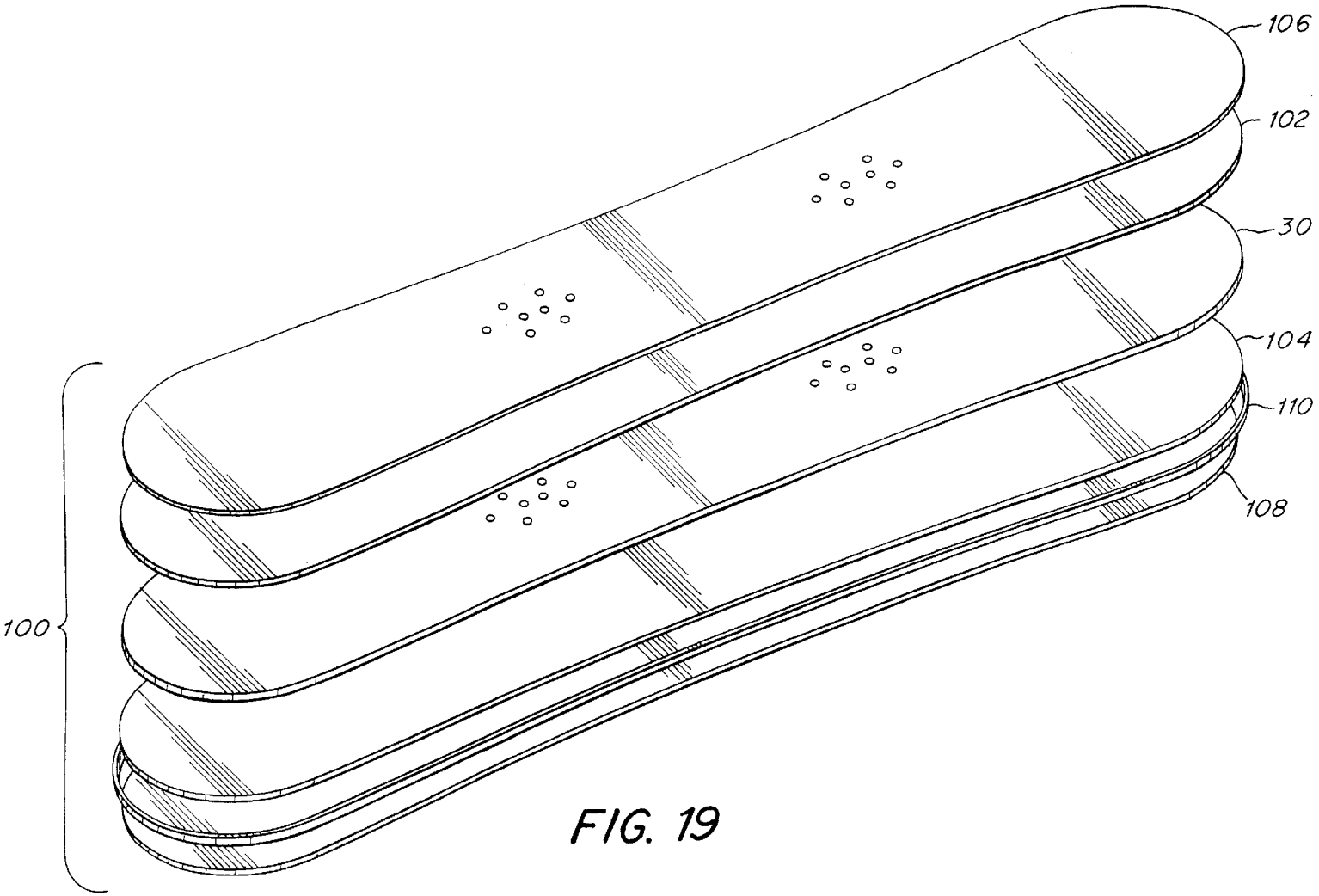
FIG. 19 is an exploded view of a snowboard incorporating the core of the present invention.

A representative gliding board, in this case a snowboard, including a core according to the present invention, is illustrated in FIG. 19. The snowboard 100 includes a core 30 formed of 10 mm wide segments of wood for the longitudinal and transverse core segments. The wood segments may be formed from one or more of balsa, aspen, wawa, ayous and fuma. The particular wood incorporated into the core is determined by several factors, such as density, strength and flex characteristics. The grain of each core segment lies in a plane that is parallel to the base plane of the core. The segments are vertically laminated together to form a thin, elongated core member having a nose-to-tail length of approximately 60¼ inches, a width of approximately 10⅝ inches at its widest point, a sidecut of approximately 1 inch, and a thickness that varies from approximately 8 mm at the central region to approximately 1.8 mm at the nose.

The core 30 is sandwiched between top and bottom reinforcing layers 102, 104, each preferably consisting of three sheets of fiberglass that are oriented at 0°, +45° and −45° from the longitudinal axis of the board, which assist in controlling longitudinal bending, transverse bending and torsional flex of the board. The reinforcing layers 102, 104 may extend beyond the edges of the core and over a sidewall (not shown) and nose and tail spacers (not shown) to protect the core from damage and deterioration. A scratch resistant top sheet 106 covers the upper reinforcing layer 102 while a gliding surface 108, typically formed from a sintered or extruded plastic, is located at the bottom of the board. Metal edges 1 10 may wrap around a partial, or preferably a full, perimeter of the board, providing a hard gripping edge for board control on snow and ice. Damping material to reduce chatter and vibrations also may be incorporated into the board.

Having described several embodiments of the invention in detail, various modifications and improvements will readily occur to those skilled in the art. Such modifications and improvements are intended to be within the spirit and scope of the invention. Accordingly, the foregoing description is by way of example only and is not intended as limiting. The invention is limited only as defined by the following claims and their equivalents.

What is claimed is:

1. A core for a gliding board, comprising:

an elongated, thin core member constructed and arranged for incorporation into a gliding board and having a nose end, a tail end and a pair of opposed edges, wherein said core member has a longitudinal axis extending in a nose-to-tail direction, a transverse axis extending in an edge-to-edge direction perpendicular to said longitudinal axis, and a normal axis that is perpendicular to a base plane extending through said longitudinal axis and said transverse axis, said core member including a plurality of vertically laminated anisotropic structures, said plurality of vertically laminated anisotropic structures including a first anisotropic structure having a first principal axis along which a mechanical property of said first anisotropic structure has a maximum value, said mechanical property being selected from the group consisting of compressive strength, compressive stiffness, compressive fatigue strength, compressive creep strength, tensile strength, tensile stiffness, tensile fatigue strength and tensile creep strength, wherein said first anisotropic structure is arranged in the core member so that it extends from at least one of said opposed edges of said core member, said first principal axis lying in a first plane extending parallel to the base plane and being oriented in a first direction that is non-parallel to each of said longitudinal axis and said transverse axis of said core member.

2. The gliding board core recited in claim 1, wherein said first principal axis is oriented at an angle of between approximately 10° and approximately 80° relative to any one of said longitudinal axis and said transverse axis.

3. The gliding board core recited in claim 2, wherein said angle is between approximately 30° and approximately 60°.

4. The gliding board core recited in claim 3, wherein said angle is approximately 45°.

5. The gliding board core recited in claim 1, wherein said plurality of vertically laminated anisotropic structures further includes a second anisotropic structure having a second principal axis along which a mechanical property of said second anisotropic structure has a maximum value, said second principal axis being oriented in a second direction that is non-parallel to said first direction of said first principal axis.

6. The gliding board core recited in claim 5, wherein said second anisotropic structure is oriented so that said second principal axis is parallel to one of said longitudinal axis and said transverse axis.

7. The gliding board core recited in claim 5, wherein said second direction is parallel to said longitudinal axis.

8. The gliding board core recited in claim 5, wherein said second direction is parallel to said transverse axis.

9. The gliding board core recited in claim 5, wherein said second anisotropic structure is oriented so that said second principal axis is non-parallel to each of said longitudinal axis and said transverse axis.

10. The gliding board core recited in claim 9, wherein said first principal axis and said second principal axis are each oriented with an angle of between approximately 10° and approximately 80° relative to any one of said longitudinal axis and said transverse axis.

11. The gliding board core recited in claim 10, wherein at least one of said angles is between approximately 30° and approximately 60°.

12. The gliding board core recited in claim 10, wherein said at least one of said angles is approximately 45°.

13. The gliding board core recited in claim 5, wherein said plurality of vertically laminated anisotropic structures includes a plurality of said first anisotropic structures and a plurality of said second anisotropic structures.

14. The gliding board core recited in claim 13, wherein said plurality of vertically laminated anisotropic structures includes a plurality of first core segments of said first anisotropic structures and a plurality of second core segments of said second anisotropic structures.

15. The gliding board core recited in claim 14, wherein said first core segments are disposed along a portion of at least one of said edges of said core member in the nose-to-tail direction.

16. The gliding board core recited in claim 15, wherein said plurality of first core segments includes a first group of first core segments and a second group of first core segments, said first and second groups of first core segments being disposed along a portion of each of said edges and being separated by said plurality of second core segments.

17. The gliding board core recited in claim 16, wherein said plurality of vertically laminated anisotropic structures includes a binding region, said first binding region being disposed in said plurality of second segments between said first and second groups of first core segments.

18. The gliding board core recited in claim 15, wherein said plurality of first core segments includes a first group of first core segments and a second group of first core segments, said first and second groups of first core segments being disposed along said portion of said at least one edge and being separated by said plurality of second core segments along said edge.

19. The gliding board core recited in claim 14, wherein at least one of a height, width or length of adjacent segments vary relative to each other.

20. The gliding board core recited in claim 1, wherein said first anisotropic structure is formed entirely from an anisotropic material.

21. The gliding board core recited in claim 1, wherein said first anisotropic structure is formed at least partially from an isotropic material.

22. The gliding board core recited in claim 1, wherein said first anisotropic structure includes wood.

23. The gliding board recited in claim 22, wherein said first principal axis of said wood anisotropic structure lies along a grain of said wood anisotropic structure.

24. The gliding board core recited in claim 1, wherein said gliding board is a snowboard.

25. The gliding board core recited in claim 24, wherein said core member is provided with a plurality of openings adapted to receive insert fasteners for securing a snowboard binding to the snowboard.

26. A core for a gliding board, comprising:

an elongated, thin core member constructed and arranged for incorporation into a gliding board and having a nose end, a tail end and a pair of opposed edges, said core member having core axes that include a longitudinal axis extending in a nose-to-tail direction, a transverse axis extending in an edge-to-edge direction perpendicular to said longitudinal axis, and a normal axis that is perpendicular to a base plane extending through said longitudinal axis and said transverse axis, said core member including a plurality of vertically laminated anisotropic structures, said plurality of vertically laminated anisotropic structures including first and second anisotropic structures respectively having first and second principal axes along which a mechanical property of said first and second anisotropic structures has a maximum value, said mechanical property being selected from the group consisting of compressive strength, compressive stiffness, compressive fatigue strength, compressive creep strength, tensile strength, tensile stiffness, tensile fatigue strength and tensile creep strength, wherein each of the first and second principal axes lies in a plane that is parallel to said base plane, said first principal axis being oriented in a first direction and said second principal axis being oriented in a second direction that is different from the first direction.

27. The gliding board core recited in claim 26, wherein said first direction is nonparallel to any one of said longitudinal axis and said transverse axis.

28. The gliding board core recited in claim 27, wherein said first principal axis is oriented with an angle of between approximately 10° and approximately 80° relative to any one of said longitudinal axis and said transverse axis.

29. The gliding board core recited in claim 28, wherein said angle is between approximately 30° and approximately 60°.

30. The gliding board core recited in claim 29, wherein said angle is approximately 45°.

31. The gliding board core recited in claim 27, wherein said second direction is parallel to said longitudinal axis.

32. The gliding board core recited in claim 27, wherein said second direction is nonparallel to any one of said longitudinal axis and said transverse axis.

33. The gliding board core recited in claim 32, wherein said second principal axis is oriented with an angle of between approximately 10° and approximately 80° relative to any one of said longitudinal axis and said transverse axis.

34. The gliding board core recited in claim 33, wherein said angle is between approximately 30° and approximately 60°.

35. The gliding board core recited in claim 34, wherein said angle is approximately 45°.

36. The gliding board core recited in claim 26, wherein said first direction is parallel to said transverse axis.

37. The gliding board core recited in claim 36, wherein said second direction is parallel to said longitudinal axis.

38. The gliding board core recited in claim 26, wherein said first principal axis is perpendicular to said second principal axis.

39. The gliding board core recited in claim 26, wherein said plurality of vertically laminated anisotropic structures includes a plurality of said first anisotropic structures and a plurality of said second anisotropic structures.

40. The gliding board core recited in claim 39, wherein said plurality of vertically laminated anisotropic structures includes a plurality of first core segments of said first anisotropic structures and a plurality of second core segments of said second anisotropic structures.

41. The gliding board core recited in claim 40, wherein said first core segments are disposed along a portion of at least one of said edges of said core member in the nose-to-tail direction.

42. The gliding board core recited in claim 41, wherein said plurality of first core segments includes a first group of first core segments and a second group of first core segments, said first and second groups of first core segments being disposed along a portion of each of said edges and being separated by said plurality of second core segments.

43. The gliding board core recited in claim 42, wherein said plurality of vertically laminated anisotropic structures includes a binding region, said binding region being disposed in said plurality of second segments between said first and second groups of first core segments.

44. The gliding board core recited in claim 41, wherein said plurality of first core segments includes a first group of first core segments and a second group of first core segments, said first and second groups of first core segments being disposed along said portion of said at least one edge and being separated by said plurality of second core segments along said edge.

45. The gliding board core recited in claim 40, wherein at least one of a height, width or length of adjacent segments vary relative to each other.

46. The gliding board core recited in claim 26, wherein said first and second anisotropic structures are formed entirely from an anisotropic material.

47. The gliding board core recited in claim 26, wherein said first and second anisotropic structures include wood.

48. The gliding board recited in claim 47, wherein said first and second principal axes of said wood anisotropic structures lie along a grain of said wood anisotropic structures.

49. The gliding board core recited in claim 26, wherein said gliding board is a snowboard.

50. The gliding board core recited in claim 49, wherein said core member is provided with a plurality of openings adapted to receive insert fasteners for securing a snowboard binding to the snowboard.

51. The gliding board core recited in claim 50, wherein said plurality of openings are disposed only in said second anisotropic structure.

52. A gliding board core, comprising:

an elongated, thin laminated wood core member constructed and arranged for incorporation into a gliding board and having a nose end, a tail end and a pair of opposed edges, said core member having a longitudinal axis extending in a nose-to-tail direction, a transverse axis extending in an edge-to-edge direction perpendicular to said longitudinal axis, and a normal axis that is perpendicular to a base plane extending through said longitudinal axis and said transverse axis, said longitudinal and normal axes defining a longitudinal plane, said core member including a plurality of first wood segments and a plurality of second wood segments, being vertically laminated to each other, and each of said first and second wood segments respectively having first and second grain directions that are nonparallel to each other, said first and second grain directions respectively lying in first and second planes that are parallel to said base plane.

53. The gliding board core recited in claim 52, wherein said plurality of first wood segments extend in a direction transverse to said longitudinal axis and said plurality of second wood segments extend in a direction parallel to said longitudinal axis, said first wood segments being disposed along an edge portion of at least one of said opposed edges, said second wood segments being disposed between said opposed edges adjacent said first wood segments.

54. The gliding board core recited in claim 53, wherein said plurality of first wood segments includes a first group of first wood segments and a second group of first wood segments, said second wood segments separating said first group of wood segments from said second group of wood segments.

55. The gliding board core recited in claim 54, wherein said first group of first wood segments is disposed along a portion of one of said edges and said second group of first wood segments is disposed along a portion of the other of said edges.

56. The gliding board core recited in claim 54, wherein said first and second groups of first wood segments are disposed along said edge portion.

57. The gliding board core recited in claim 53, wherein said core member has a plurality of openings adapted to receive fastener inserts for securing bindings to said gliding board, said openings being disposed in said second wood segments adjacent said first wood segments.

58. The gliding board core recited in claim 57, wherein said core member includes a first group of openings and a second group of openings that is spaced from the first group of openings in the nose-to-tail direction to receive fastener inserts for securing a pair of bindings to the gliding board, said first wood segments extending along said edge portion from said first group of openings to said second group of openings.

59. The gliding board core recited in claim 58, wherein said edge portion includes a first portion along one edge of said core member and a second portion along the other edge of said core member.

60. The gliding board core recited in claim 58, wherein said first and second edge portions each has a length of approximately 60 cm to approximately 80 cm.

61. The gliding board core recited in claim 58, wherein said edge portion has a width of approximately 2 cm to approximately 5 cm.

62. The gliding board core recited in claim 52, wherein said first grain direction is transverse to said longitudinal axis.

63. The gliding board core recited in claim 62, wherein said second grain direction is parallel to said longitudinal axis.

64. The gliding board core recited in claim 63, wherein said first grain direction is parallel to said transverse axis.

65. The gliding board core recited in claim 63, wherein said first grain direction is nonparallel to said transverse axis.

66. The gliding board core recited in claim 65, wherein said first grain direction is oriented with an angle of between approximately 10° and approximately 80° relative to said transverse axis.

67. The gliding board core recited in claim 66, wherein said angle is between approximately 30° and approximately 60°.

68. The gliding board core recited in claim 67, wherein said angle is approximately 45°.

69. The gliding board core recited in claim 52, wherein at least one of said nose and tail endsis rounded.

70. The gliding board core recited in claim 52, wherein core member has a thickness that varies in the nose-to-tail direction.

71. The gliding board of claim 5, wherein said plurality of anisotropic structures are formed of an anisotropic material.

72. The gliding board of claim 39, wherein said plurality of anisotropic structures are formed of an anisotropic material.

73. A core for a gliding board, comprising:

an elongated core member constructed and arranged for incorporation into a gliding board, said core member including top and bottom outer surfaces and having a nose end, a tail end and a pair of opposed edges, wherein said core member has a longitudinal axis extending in a nose-to-tail direction, a transverse axis extending in an edge-to-edge direction perpendicular to said longitudinal axis, and a normal axis that is perpendicular to a base plane extending through said longitudinal axis and said transverse axis, said core member including a first anisotropic structure extending continuously from said top outer surface to said bottom outer surface, said first anisotropic structure having a first principal axis along which a mechanical property of the first anisotropic structure has a maximum value, said mechanical property being selected from the group consisting of compressive strength, compressive stiffness, compressive fatigue strength, compressive creep strength, tensile strength, tensile stiffness, tensile fatigue strength and tensile creep strength, wherein said first anisotropic structure is arranged in the core member so that it extends from at least one of said opposed edges of said core member, said first principal axis lying in a first plane extending parallel to the base plane and being oriented in a first direction that is non-parallel to each of said longitudinal axis and said transverse axis of said core member.

74. The gliding board core recited in claim 73, wherein said first principal axis is oriented at an angle of between approximately 10° and approximately 80° relative to any one of said longitudinal axis and said transverse axis.

75. The gliding board core recited in claim 74, wherein said angle is approximately 45°.

76. The gliding board core recited in claim 73, wherein said core member includes a second anisotropic structure extending continuously from said top outer surface to said bottom outer surface, said second anisotropic structure having a second principal axis along which a mechanical property of said second anisotropic structure has a maximum value, said second principal axis being oriented in a second direction that is non-parallel to said first direction of said first principal axis.

77. The gliding board core recited in claim 76, wherein said second anisotropic structure is oriented so that said second principal axis is parallel to one of said longitudinal axis and said transverse axis.

78. The gliding board core recited in claim 76, wherein said second direction is parallel to said longitudinal axis.

79. The gliding board core recited in claim 76, wherein said second anisotropic structure is oriented so that said second principal axis is non-parallel to each of said longitudinal axis and said transverse axis.

80. The gliding board core recited in claim 76, wherein said core member includes a plurality of said first anisotropic structures and a plurality of said second anisotropic structures.

81. The gliding board core recited in claim 80, wherein said core member includes a plurality of first core segments of said first anisotropic structures and a plurality of second core segments of said second anisotropic structures.

82. The gliding board core recited in claim 81, wherein said first core segments extend along a portion of at least one of said edges of said core member in the nose-to-tail direction.

83. The gliding board core recited in claim 82, wherein said plurality of first core segments includes a first group of first core segments and a second group of first core segments, said first and second groups of first core segments extending along a portion of each of said edges and being separated by said plurality of second core segments.

84. The gliding board core recited in claim 83, wherein said core member includes a binding region, said first binding region being disposed in said plurality of second segments between said first and second groups of first core segments.

85. The gliding board core recited in claim 80, wherein at least one of a height, width or length of adjacent segments vary relative to each other.

86. A core for a gliding board, comprising:

an elongated core member constructed and arranged for incorporation into a gliding board, said core member including top and bottom outer surfaces and having a nose end, a tail end and a pair of opposed edges, said core member having core axes that include a longitudinal axis extending in a nose-to-tail direction, a transverse axis extending in an edge-to-edge direction perpendicular to said longitudinal axis, and a normal axis that is perpendicular to a base plane extending through said longitudinal axis and said transverse axis, said core member including first and second anisotropic structures extending continuously from said top outer surface to said bottom outer surface, said first and second anisotropic structures respectively having first and second principal axes along which a mechanical property of said first and second anisotropic structures has a maximum value, said mechanical property being selected from the group consisting of compressive strength, compressive stiffness, compressive fatigue strength, compressive creep strength, tensile strength, tensile stiffness, tensile fatigue strength and tensile creep strength, wherein each of said first and second principal axes lies in a plane that is parallel to said base plane, said first principal axis being oriented in a first direction and said second principal axis being oriented in a second direction that is different from the first direction.

87. The gliding board core recited in claim 86, wherein said first direction is nonparallel to any one of said longitudinal axis and said transverse axis.

88. The gliding board core recited in claim 87, wherein said first principal axis is oriented with an angle of between approximately 10° and approximately 80° relative to any one of said longitudinal axis and said transverse axis.

89. The gliding board core recited in claim 87, wherein said second direction is parallel to said longitudinal axis.

90. The gliding board core recited in claim 87, wherein said second direction is nonparallel to any one of said longitudinal axis and said transverse axis.

91. The gliding board core recited in claim 90, wherein said second principal axis is oriented with an angle of between approximately 10° and approximately 80° relative to any one of said longitudinal axis and said transverse axis.

92. The gliding board core recited in claim 86, wherein said first direction is parallel to said transverse axis.

93. The gliding board core recited in claim 92, wherein said second direction is parallel to said longitudinal axis.

94. The gliding board core recited in claim 86, wherein said first principal axis is perpendicular to said second principal axis.

95. The gliding board core recited in claim 86, wherein said core member includes a plurality of said first anisotropic structures and a plurality of said second anisotropic structures.

96. The gliding board core recited in claim 95, wherein said core member includes a plurality of first core segments of said first anisotropic structures and a plurality of second core segments of said second anisotropic structures.

97. The gliding board core recited in claim 96, wherein said first core segments extend along a portion of at least one of said edges of said core member in the nose-to-tail direction.

98. The gliding board core recited in claim 97, wherein said plurality of first core segments includes a first group of first core segments and a second group of first core segments, said first and second groups of first core segments extending along a portion of each of said edges and being separated by said plurality of second core segments.

99. The gliding board core recited in claim 98, wherein said core member includes a binding region, said binding region being disposed in said plurality of second segments between said first and second groups of first core segments.

100. The gliding board core recited in claim 97, wherein said plurality of first core segments includes a first group of first core segments and a second group of first core segments, said first and second groups of first core segments extending along said portion of said at least one edge and being separated by said plurality of second core segments along said edge.

101. The gliding board core recited in claim 96, wherein at least one of a height, width or length of adjacent segments vary relative to each other.

102. A core for a gliding board, comprising:

an elongated core member constructed and arranged for incorporation into a gliding board, said core member including top and bottom outer surfaces and having a nose end, a tail end and a pair of opposed edges, wherein said core member has a longitudinal axis extending in a nose-to-tail direction, a transverse axis extending in an edge-to-edge direction perpendicular to said longitudinal axis, and a normal axis that is perpendicular to a base plane extending through said longitudinal axis and said transverse axis, said core member including a first anisotropic structure that is formed from a material selected from the group consisting of a fiber-impregnated resin and a molded thermoplastic, said first anisotropic structure having a principal axis along which a mechanical property has a maximum value, said mechanical property being selected from the group consisting of compressive strength, compressive stiffness, compressive fatigue strength, compressive creep strength, tensile strength, tensile stiffness, tensile fatigue strength, and tensile creep strength, wherein said first anisotropic structure is arranged so that it extends from at least one of said opposed edges of said core member, said first principal axis lying in a first plane extending parallel to the base plane and being oriented in a first direction that is non-parallel to each of said longitudinal axis and said transverse axis of said core member.

103. The gliding board recited in claim 102, wherein said first principal axis is oriented with at least one angle of between approximately 10° and approximately 80° relative to any one of said longitudinal and said transverse axis.

104. The gliding board core recited in claim 103, wherein said angle is approximately 45°.

105. The gliding board core recited in claim 102, wherein said core member further includes a second anisotropic structure formed from an anisotropic material and having a second principal axis along which a mechanical property of said second anisotropic structure has a maximum value, said second principal axis being oriented in a second direction that is non-parallel to said first direction of said first principal axis.

106. The gliding board core recited in claim 105, wherein said second anisotropic structure is oriented so that said second principal axis is parallel to one of said longitudinal axis and said transverse axis.

107. The gliding board core recited in claim 105, wherein said second direction is parallel to said longitudinal axis.

108. The gliding board core recited in claim 105, wherein said second anisotropic structure is oriented so that said second principal axis is non-parallel to each of said longitudinal axis and said transverse axis.

109. The gliding board core recited in claim 102, wherein said core member includes a plurality of said first anisotropic structures and a plurality of said second anisotropic structures.

110. The gliding board core recited in claim 107, wherein said core member includes a plurality of first core segments of said first anisotropic structures and a plurality of second core segments of said second anisotropic structures.

111. The gliding board core recited in claim 110, wherein said first core segments extend along a portion of at least one of said edges of said core member in the nose-to-tail direction.

112. The gliding board core recited in claim 111, wherein said plurality of first core segments includes a first group of first core segments and a second group of first core segments, said first and second groups of first core segments extending along a portion of each of said edges and being separated by said plurality of second core segments.

113. The gliding board core recited in claim 112, wherein said core member includes a binding region, said first binding region being disposed in said plurality of second segments between said first and second groups of first core segments.

114. The gliding board core recited in claim 110, wherein at least one of a height, width or length of adjacent segments vary relative to each other.

115. The gliding board core recited in claim 102, wherein said fiber-impregnated resin includes a plurality of fibers oriented in a first direction.

116. The gliding board core recited in claim 102, wherein said gliding board is a snowboard.

117. A core for a gliding board, comprising:

an elongated core member constructed and arranged for incorporation into a gliding board, said core member including top and bottom outer surfaces and having a nose end, a tail end and a pair of opposed edges, said core member having core axes that include a longitudinal axis extending in a nose-to-tail direction, a transverse axis extending in an edge-to-edge direction perpendicular to said longitudinal axis, and a normal axis that is perpendicular to a base plane extending through said longitudinal axis and said transverse axis, said core member including first and second anisotropic structures formed from a material selected from the group consisting of a fiber-impregnated resin and a molded thermoplastic, said first and second anisotropic structures respectively having first and second principal axes along which a mechanical property of said first and second anisotropic structures has a maximum value, said mechanical property being selected from the group consisting of compressive strength, compressive stiffness, compressive fatigue strength, compressive creep strength, tensile strength, tensile stiffness, tensile fatigue strength, and tensile creep strength, wherein each of said first and second principal axes lies in a plane that is parallel to said base plane, said first principal axis being oriented in a first direction and said second principal axis being oriented in a second direction that is different from the first direction.

118. The gliding board core recited in claim 117, wherein said first direction is nonparallel to any one of said longitudinal axis and said transverse axis.

119. The gliding board core recited in claim 118, wherein said first principal axis is oriented with an angle of between approximately 10° and approximately 80° relative to any one of said longitudinal axis and said transverse axis.

120. The gliding board core recited in claim 118, wherein said second direction is parallel to said longitudinal axis.

121. The gliding board core recited in claim 118, wherein said second direction is nonparallel to any one of said longitudinal axis and said transverse axis.

122. The gliding board core recited in claim 121, wherein said second principal axis is oriented with an angle of between approximately 10° and approximately 80° relative to any one of said longitudinal axis and said transverse axis.

123. The gliding board core recited in claim 117, wherein said first direction is parallel to said transverse axis.

124. The gliding board core recited in claim 123, wherein said second direction is parallel to said longitudinal axis.

125. The gliding board core recited in claim 117, wherein said first principal axis is perpendicular to said second principal axis.

126. The gliding board core recited in claim 117, wherein said core member includes a plurality of said first anisotropic structures and a plurality of said second anisotropic structures.

127. The gliding board core recited in claim 126, wherein said core member includes a plurality of first core segments of said first anisotropic structures and a plurality of second core segments of said second anisotropic structures.

128. The gliding board core recited in claim 127, wherein said first core segments extend along a portion of at least one of said edges of said core member in the nose-to-tail direction.

129. The gliding board core recited in claim 128, wherein said plurality of first core segments includes a first group of first core segments and a second group of first core segments, said first and second groups of first core segments extending along a portion of each of said edges and being separated by said plurality of second core segments.

130. The gliding board core recited in claim 129, wherein said core member includes a binding region, said binding region being disposed in said plurality of second segments between said first and second groups of first core segments.

131. The gliding board core recited in claim 128, wherein said plurality of first core segments includes a first group of first core segments and a second group of first core segments, said first and second groups of first core segments extending along said portion of said at least one edge and being separated by said plurality of second core segments along said edge.

132. The gliding board core recited in claim 127, wherein at least one of a height, width or length of adjacent segments vary relative to each other.

* * * * *